US007637203B2

(12) United States Patent
Moss

(10) Patent No.: US 7,637,203 B2
(45) Date of Patent: Dec. 29, 2009

(54) AIR PUMP

(76) Inventor: Robert A. Moss, 8 Pine Glen Rd., Simsbury, OH (US) 06070

( * ) Notice: Subject to any disclaimer, the term of this patent is extended or adjusted under 35 U.S.C. 154(b) by 338 days.

(21) Appl. No.: 11/464,192

(22) Filed: Aug. 12, 2006

(65) Prior Publication Data

US 2008/0034960 A1 Feb. 14, 2008

(51) Int. Cl.
*F01B 9/00* (2006.01)

(52) U.S. Cl. ..... 92/140

(58) Field of Classification Search ..... 92/140; 74/110; 417/903

See application file for complete search history.

(56) References Cited

U.S. PATENT DOCUMENTS

| | | | | |
|---|---|---|---|---|
| 551,157 | A | 12/1895 | De Clerco | |
| 764,706 | A * | 7/1904 | Braunwalder | 74/110 |
| 784,593 | A * | 3/1905 | Resor | 417/903 |
| 787,960 | A * | 4/1905 | Temple | 92/140 |
| 806,140 | A | 12/1905 | Helm | |
| 1,315,089 | A | 9/1919 | Camfield | |
| 1,377,563 | A | 5/1921 | Davies | |
| 1,396,214 | A | 11/1921 | Jensen | |
| 1,452,870 | A | 4/1923 | Davies | |
| 1,774,418 | A * | 8/1930 | Cairncross | 74/110 |
| 1,857,220 | A | 5/1932 | Thumim | |
| 2,087,885 | A | 7/1937 | Fleischel | |
| 2,145,704 | A | 1/1939 | Wood | |
| 2,146,299 | A | 2/1939 | Joy | |
| 2,781,166 | A | 2/1957 | Flood et al. | |
| 3,945,304 | A | 3/1976 | Taylor | |
| 3,999,533 | A | 12/1976 | Buckner | |
| 4,256,141 | A | 3/1981 | Peters | |
| 4,304,213 | A | 12/1981 | Jereckos | |
| 4,526,520 | A | 7/1985 | Henderson | |
| 4,844,046 | A | 7/1989 | Straub | |
| 4,928,661 | A | 5/1990 | Bordt et al. | |
| 5,118,265 | A | 6/1992 | Bearss | |
| 5,538,398 | A | 7/1996 | Elson | |
| 5,649,454 | A | 7/1997 | Midha et al. | |
| 5,807,078 | A | 9/1998 | Chen | |
| 6,325,601 | B2 | 12/2001 | Wu | |
| 6,343,598 | B1 | 2/2002 | Pshenychny | |
| 6,371,741 | B1 | 4/2002 | Wu | |
| 6,592,343 | B1 | 7/2003 | Pshenychny | |
| 6,748,818 | B2 | 6/2004 | Jensen et al. | |
| 6,957,646 | B2 | 10/2005 | Nibecker | |
| 2004/0154599 | A1 | 8/2004 | Nibecker | |

* cited by examiner

*Primary Examiner*—F. Daniel Lopez
(74) *Attorney, Agent, or Firm*—Klarquist Sparkman, LLP

(57) ABSTRACT

An air pump comprises a cylinder, a piston, a piston rod, three substantially rigid members, and a handle. The piston is reciprocably movable within the cylinder and is secured to the piston rod. The first member is pivotably connected at its first end to the cylinder. The second member is pivotably connected at its first end to the piston rod and at its second end to the second end of the first member. The third member is pivotably connected at its first end to the connected second ends of the first and second members. The handle is pivotably connected to the second end of the third member. The third member is arranged to transmit between the handle and the connected second ends of the first and second members a force resulting from a force applied to the handle.

7 Claims, 17 Drawing Sheets

AIR PUMP

BACKGROUND

The field of the present invention relates to air pumps. In particular, air pumps are described herein requiring reduced force to achieve a given pressure.

Many previous air pumps exhibit applied force versus pump stroke distance profiles that increase steeply toward the end of the pump stroke, or are sharply peaked near the end of the pump stroke. The large forces required are often difficult, if not impossible, for a user to achieve. Stroke volumes of many prior pumps are small, so that dozens or even hundreds of strokes are required to pressurize an adequate volume of air (to fill a tire or pressurize a reservoir, for example. It may be desirable to provide a pump wherein the applied force versus pump stroke distance is less steep, less highly peaked, or somewhat flattened; or it may be desirable to provide a pump having an increased stroke volume without a concomitant increase in pump force required.

SUMMARY

An air pump comprises a cylinder, a piston, a piston rod, at least three substantially rigid members, and a handle. The piston is reciprocably movable within the cylinder and defines a compression volume within the cylinder between the piston and the first end of the cylinder. The piston rod is substantially rigidly secured to the piston and extends along the cylinder toward its second end. The first member is pivotably connected at its first end to the cylinder. The second member is pivotably connected at its first end to the piston rod and is pivotably connected at its second end to the second end of the first member. The third member is pivotably connected at its first end to the connected second ends of the first and second members. The handle is pivotably connected to the second end of the third member. The third member is arranged to transmit between the handle and the connected second ends of the first and second members a force resulting from a force applied to the handle.

Objects and advantages pertaining to air pumps may become apparent upon referring to the exemplary embodiments illustrated in the drawings and disclosed in the following written description or claims.

Figure 1A:
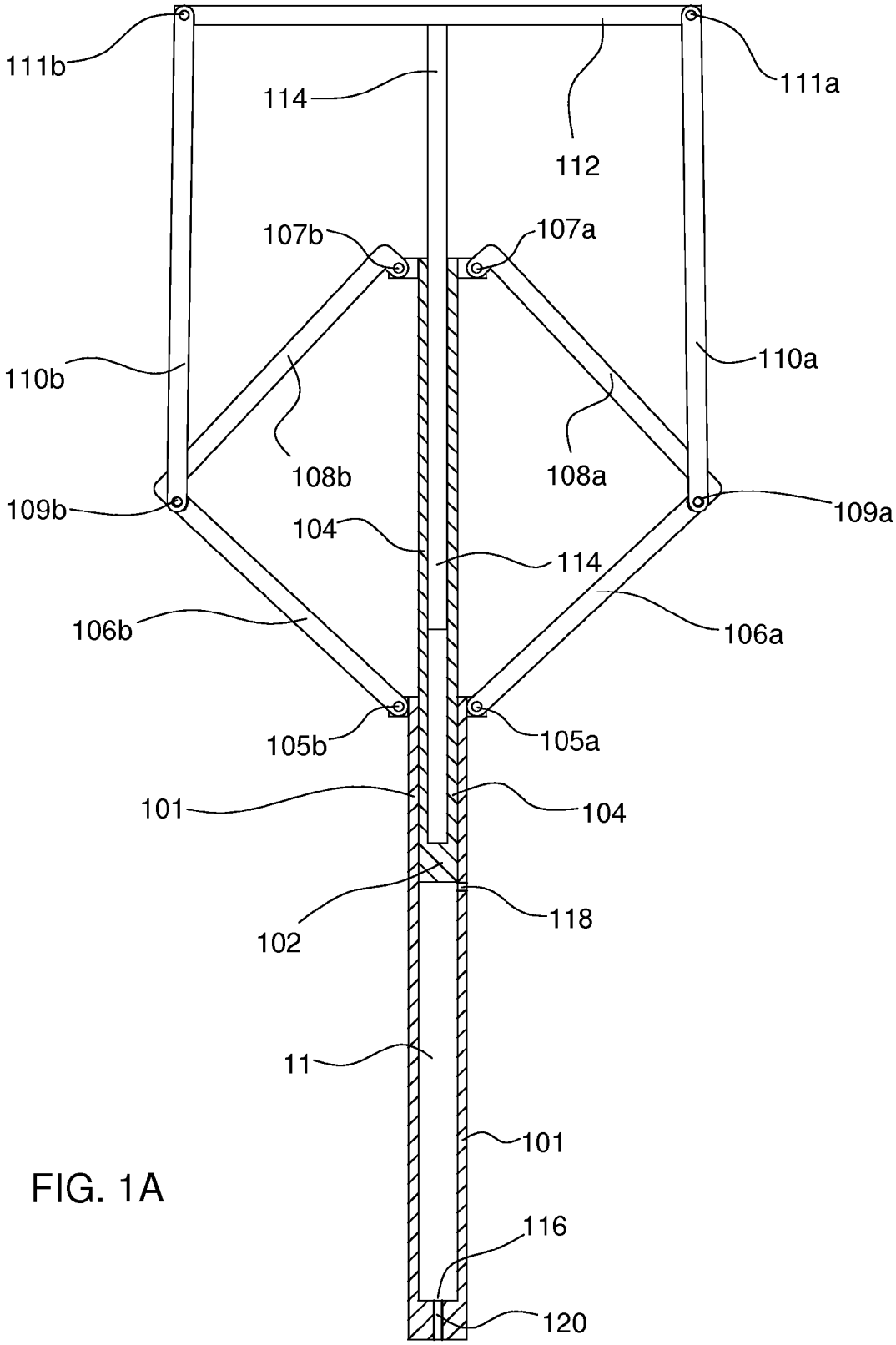
FIGS. 1A-1F illustrate schematically structure and operation of an exemplary embodiment of an air pump.
Figure 1B:
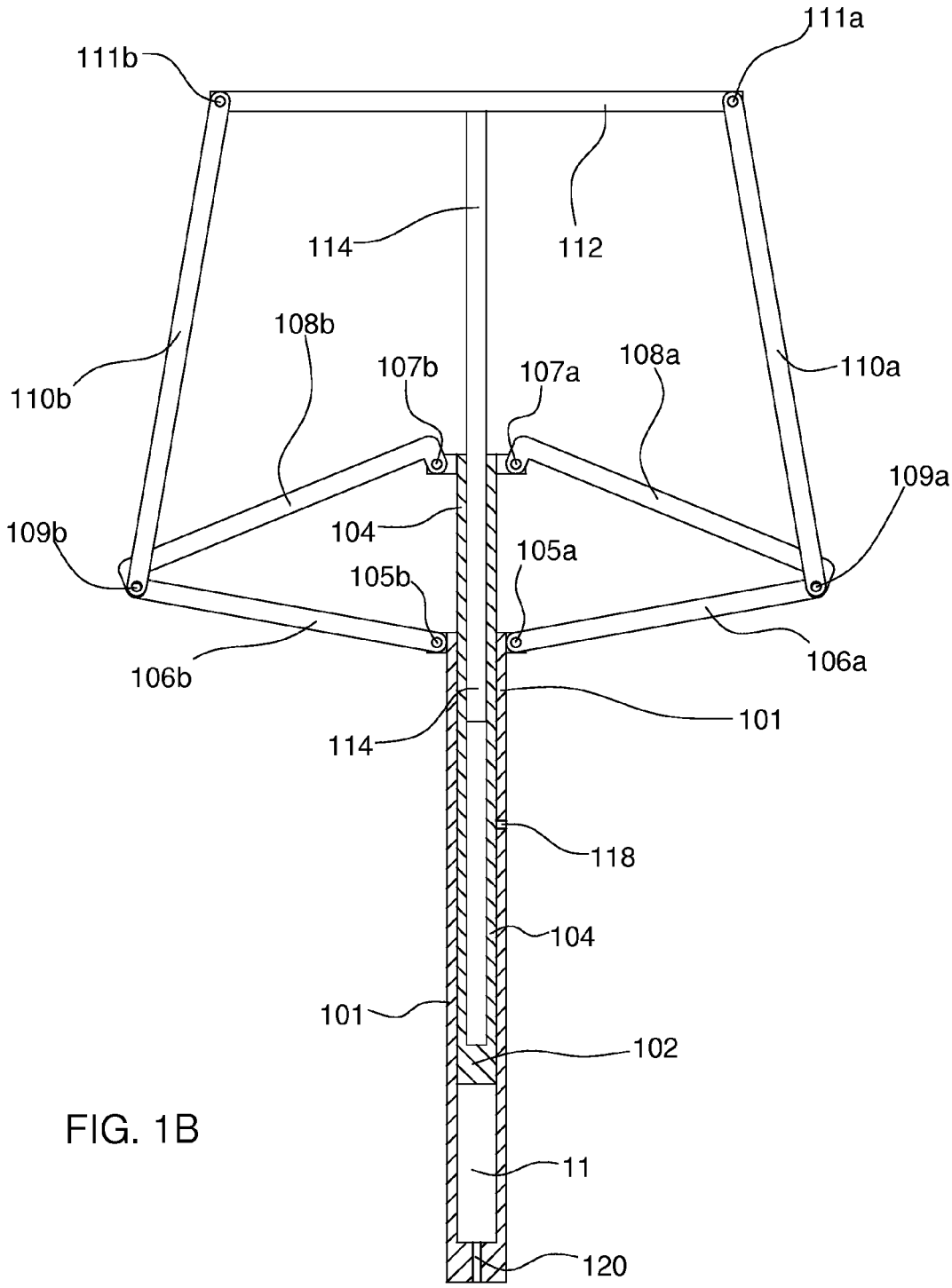
Figure 1C:
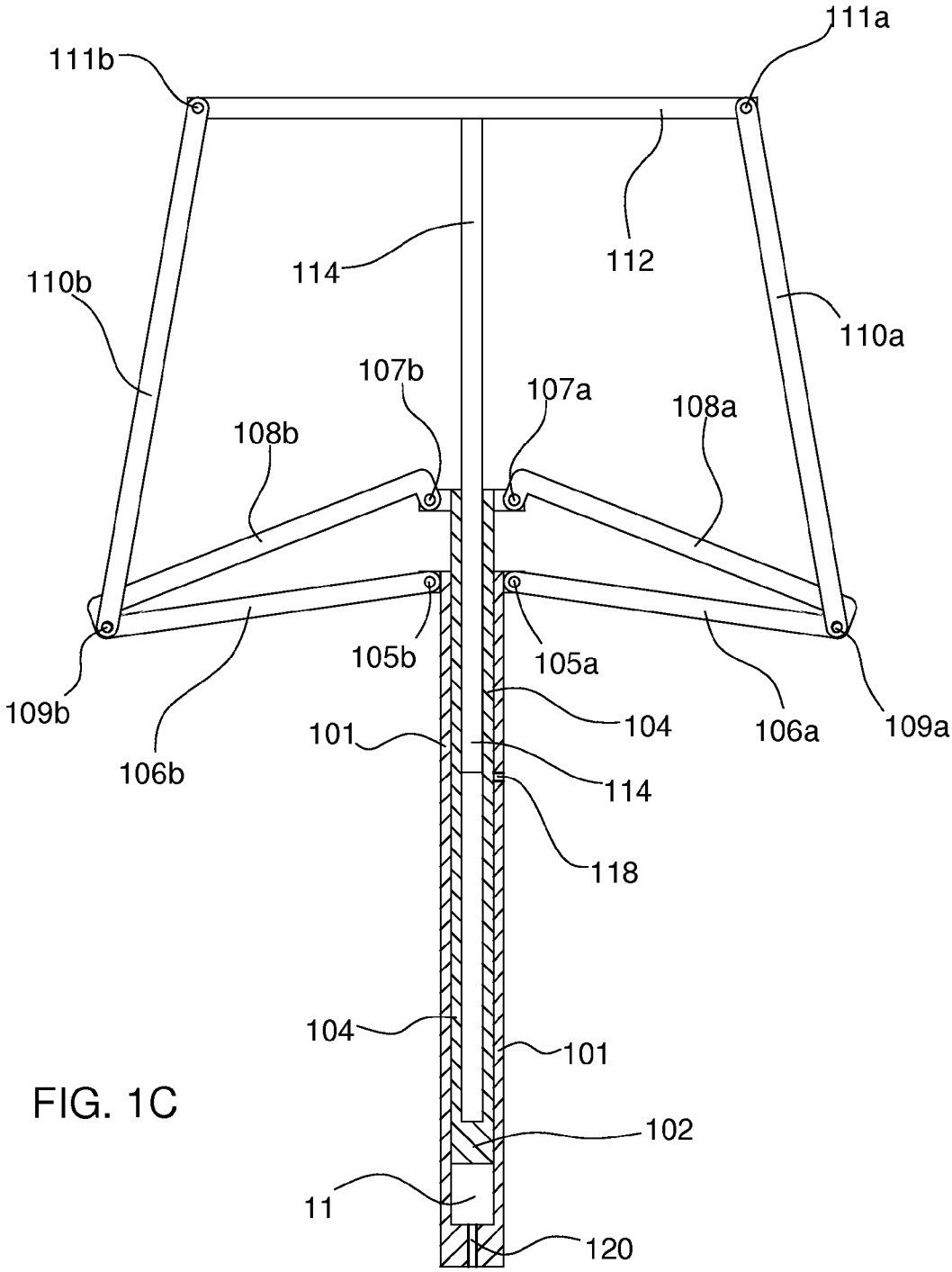
Figure 1D:
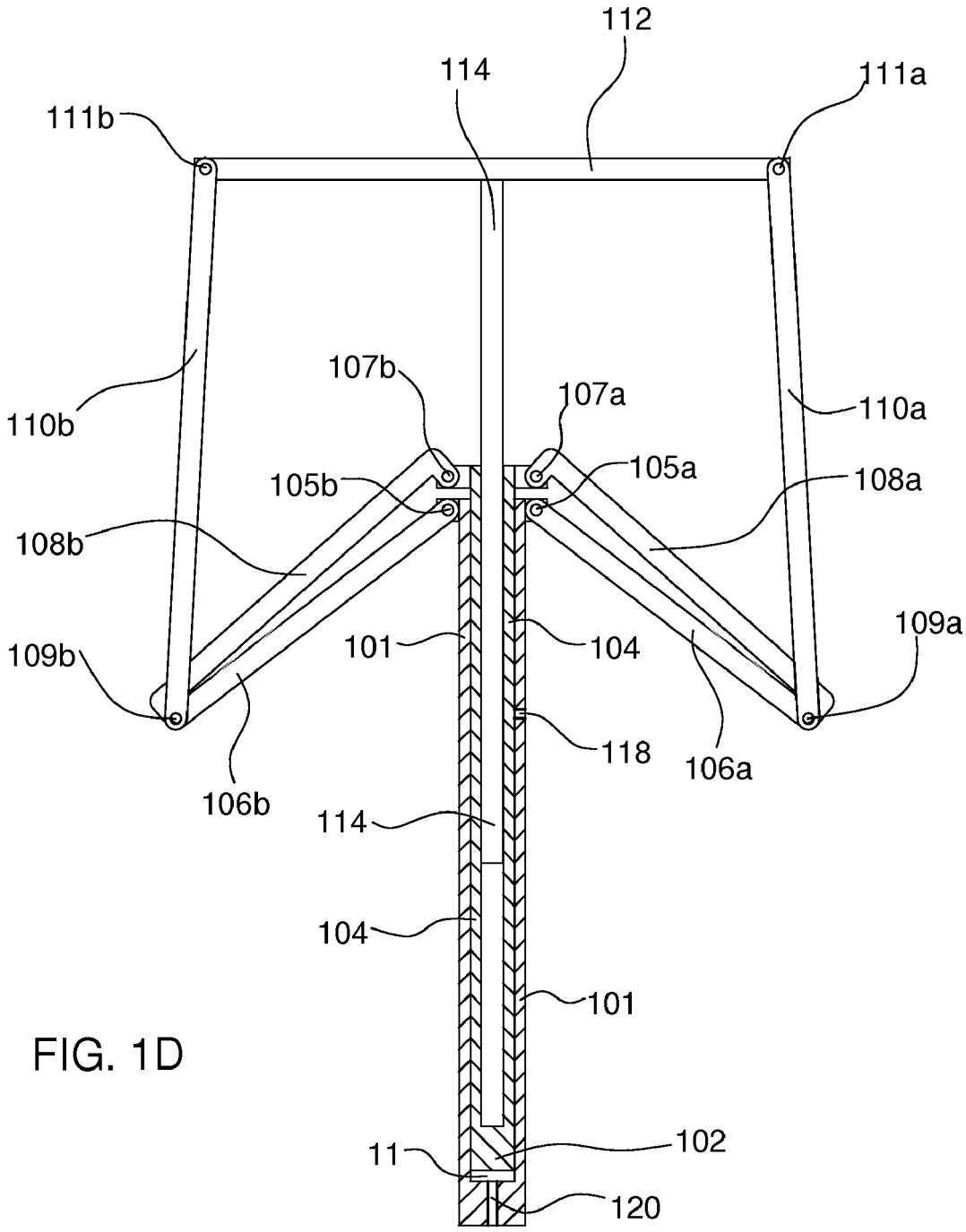
Figure 1E:
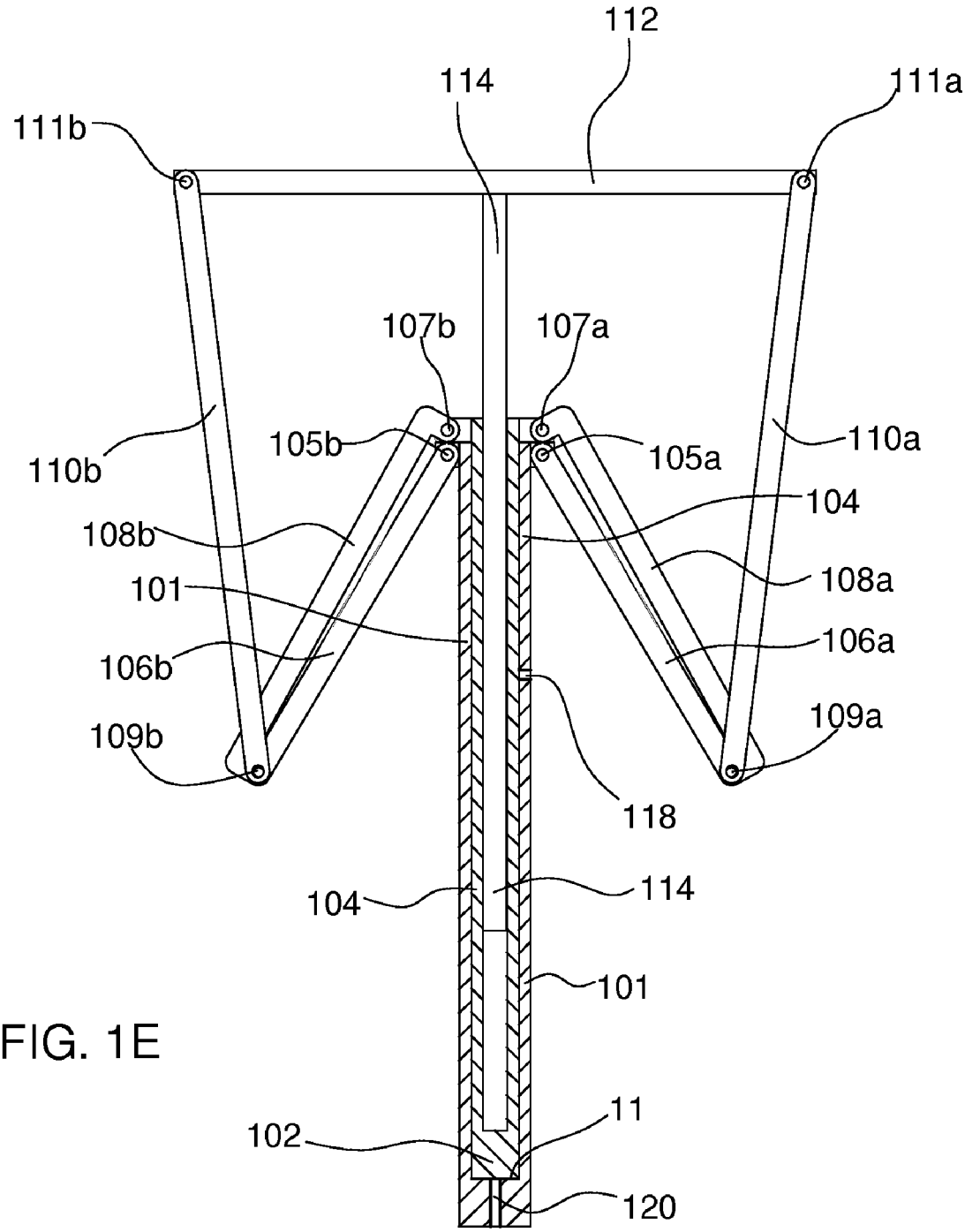
Figure 1F:
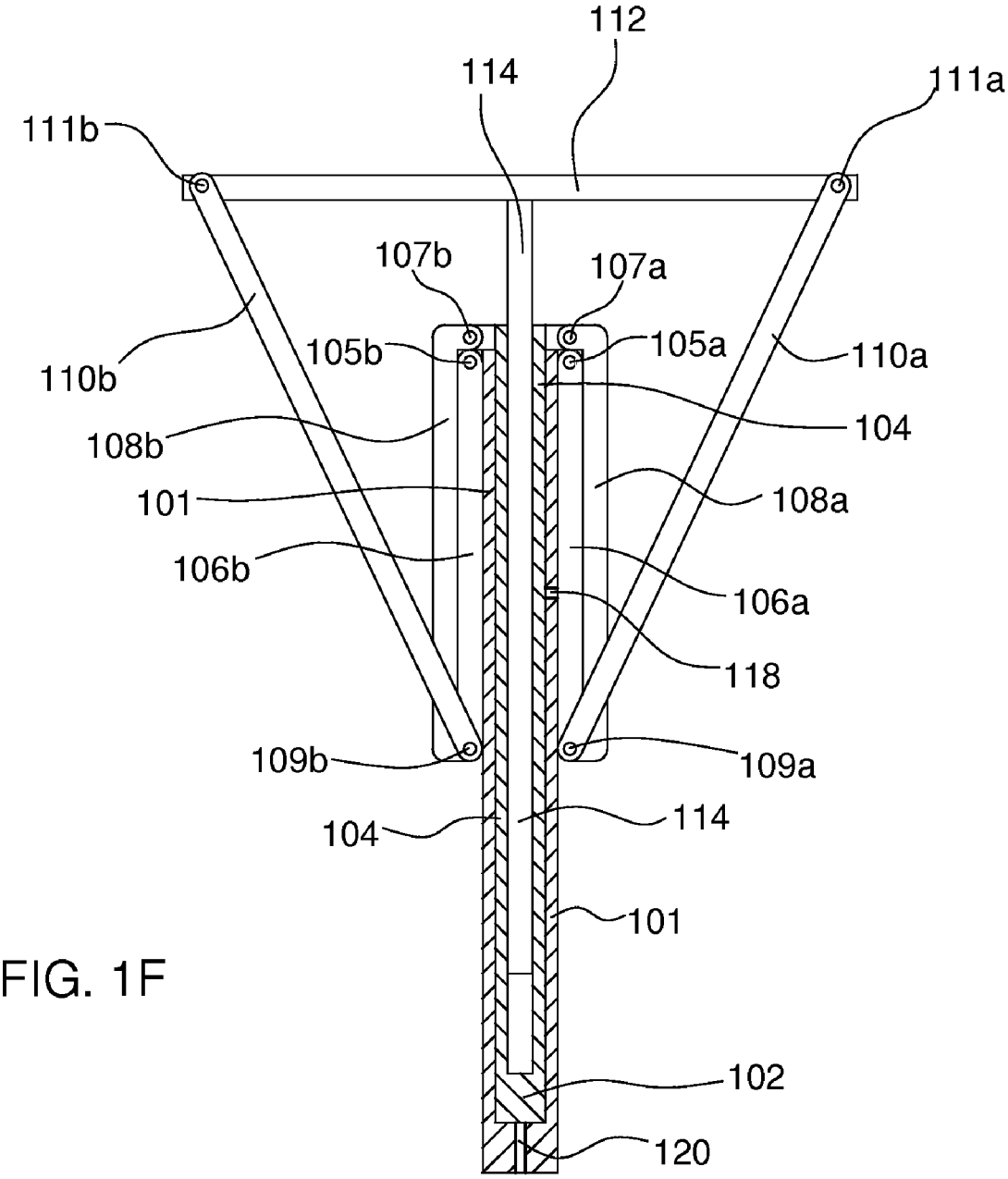

The embodiments shown in the Figures are exemplary, and should not be construed as limiting the scope of the present disclosure or appended claims.

DETAILED DESCRIPTION OF EMBODIMENTS

A first exemplary embodiment of an air pump is shown in FIGS. 1A-1F, and comprises: a cylinder 101; a piston 102; a piston rod 104; a first set of three substantially rigid members 106*a*, 108*a*, and 110*a*; a second set of three substantially rigid members 106*b*, 108*b*, and 110*b*; and a handle 112. Piston 102 is reciprocably movable within the cylinder 101 and defines a compression volume 11 within the cylinder 101 between the piston 102 and the first end 116 of the cylinder 101. Piston rod 104 is substantially rigidly secured to the piston 102 and extends along the cylinder 101 toward its second end. The first substantially rigid member 106*a* is pivotably connected at its first end to the cylinder 101 at pivot 105*a*. The second substantially rigid member 108*a* is pivotably connected at its first end to the piston rod 104 at pivot 107*a* and pivotably connected at its second end to the second end of the first member 106*a* at pivot 109*a*. The third substantially rigid member 110*a* is pivotably connected at its first end to the connected second ends of the first and second members 106*a* and 108*a* at pivot 109*a*. The handle 112 is pivotably connected to the second end of the third member 110*a* at pivot 111*a*.

In the exemplary embodiment, rotation axes of the pivots 105*a*, 107*a*, 109*a*, and 111*a* connecting the cylinder 101, the piston rod 104, the members 106*a*, 108*a*, and 110*a*, and the handle 112 are substantially parallel to one another and are substantially perpendicular to the axis of the cylinder 101. This arrangement of the pivots 105*a*, 107*a*, 109*a*, and 111*a* results in substantially coplanar arrangement and movement of the members 106*a*, 108*a*, and 110*a* as the piston 102 moves along the cylinder 101. Other suitable arrangements shall fall within the scope of the present disclosure or appended claims. The third member 110*a* is arranged to transmit, between the handle 112 and the connected second ends of the first and second members 106*a* and 108*a*, a force generally directed toward the first end 116 of the cylinder 101 resulting from a force applied to the handle 112 and generally directed toward the first end 116 of the cylinder.

In the exemplary embodiment of FIGS. 1A-1F, the handle 112 is reciprocably movable in a direction substantially parallel to the cylinder 101 and is substantially constrained to linear reciprocating motion by guide rod 114. Guide rod 114 is connected to the handle 112 and reciprocably movable within the piston rod 104. Other suitable structures or arrangements may be employed for guiding substantially linear reciprocating movement of handle 112 in a direction substantially parallel to cylinder 101.

The exemplary embodiment of FIGS. 1A-1F further comprises a second set of members 106*b*, 108*b*, and 110*b* connected to the cylinder 101, piston rod 104, and each other at pivots 105*b*, 107*b*, 109*b*, and 111*b* in an arrangement similar to that of the members 106*a*, 108*a*, and 110*a* and the pivots 105*a*, 107*a*, 109*a*, and 111*a*. In this example, the second set of members is arranged on the opposing side of cylinder 101 relative to the first set of members, resulting in substantially coplanar arrangement and movement of all six members as piston 102 moves along cylinder 101. Such a symmetric arrangement applies equivalent forces on pivots 107*a* and 107*b* and maintains a substantially axisymmetric load on piston rod 104, reducing the potential for bending the piston rod. In alternative embodiments, other positions for the second set of members may be employed, or additional sets of members similarly arranged with pivotable connections among themselves, cylinder 101, and piston rod 104 may be employed.

The operation of this exemplary pump is illustrated in the sequence of FIGS. 1A-1F. In FIG. 1A, the pump is shown at the beginning of a stroke, with the piston 102 at its furthest position from the first end 116 of cylinder 101 and the compression volume 11 at its maximum size. Any suitable inlet may be provided for allowing air to enter the compression volume. For example, a hole 118 in the side of cylinder 101 may be positioned to allow ambient air to enter the compression volume 11 when piston 102 is at the beginning of a stroke. Once the piston 102 passes the hole 118 during a pump stroke, the air trapped within the compression volume 11 is compressed by further movement of the piston 102 within cylinder 101. Other suitable structures or mechanisms may be employed for allowing entry of air into compression volume 101 at the beginning of a pump stroke. Examples may include: a check valve in the side or end of the cylinder; or a sliding o-ring or other suitable seal arranged for forming a seal during the downstroke and for permitting leakage during the upstroke. Air compressed during the pump stroke may exit the compression volume through outlet 120 at the first end 116 of cylinder 101. Any suitable structure or mechanism may be employed at outlet 120, including, e.g., a check valve in the cylinder or in the outlet 120, or a check valve in a fitting connected to the outlet 120.

Figure 3A:
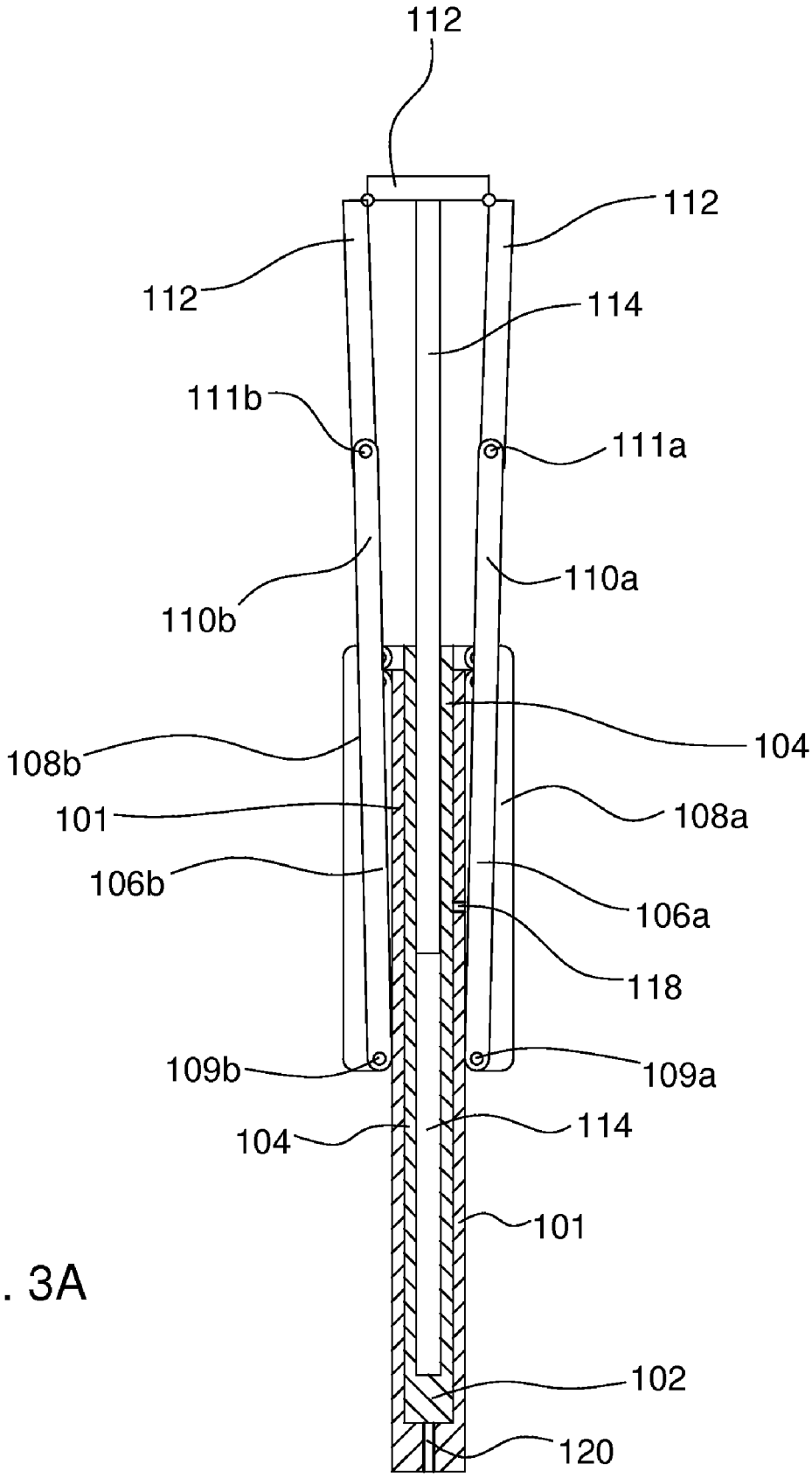
FIG. 3A illustrates schematically an exemplary embodiment of an air pump with a folding handle.
Figure 3B:
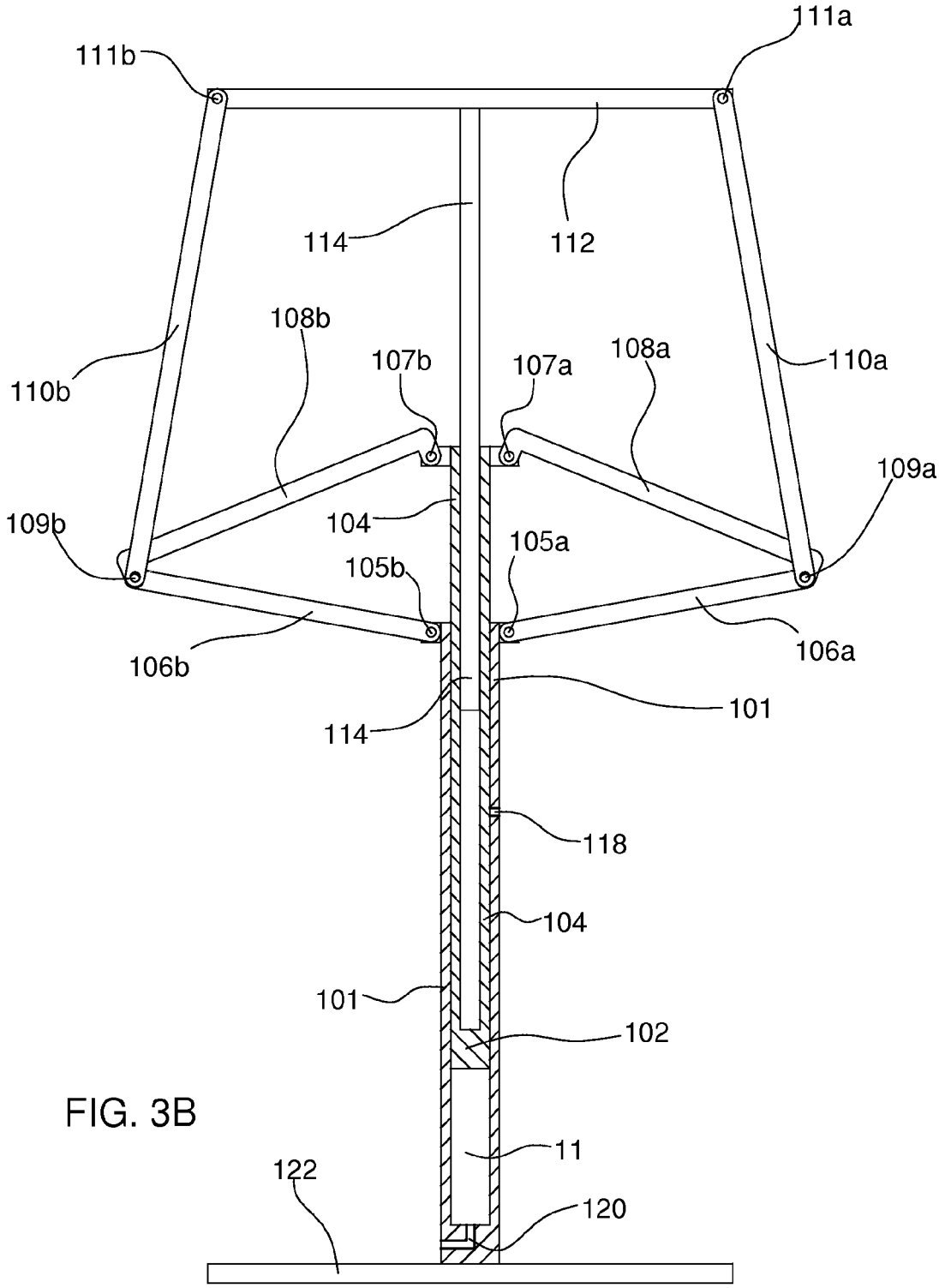
FIG. 3B illustrates schematically an exemplary embodiment of an air pump with a base.

In the following, the arrangements and movements of members 106*a*, 108*a*, and 110*a* are described, and are to be understood to apply equivalently to members 106*b*, 108*b*, and 110*b* in this example. As force is applied in a downward direction on handle 112, it moves downward, with guide rod 114 sliding into piston rod 104. The force applied to handle 112 is transmitted to the connected ends of the members 106*a* and 108*a* at pivot 109*a* by member 110*a* as a force directed generally toward the first end 116 of cylinder 101. This results in downward rotation of member 106*a* about pivot 105*a*, and tension being applied to member 108*a*, which in turn urges piston rod 104 and piston 102 downward within cylinder 101 and reduces the compression volume 11. The sequence of movements is illustrated in FIGS. 1A-1F. Once piston 102 passes hole 118 (as in FIG. 3B), the air trapped within the compression volume 11 is compressed by further movement of piston 102 downward within cylinder 101. The end of the pump stroke (i.e., downstroke) and minimum compression volume occurs when pivot 107*a* reaches pivot 105*a* and can go no further (as in FIG. 1F), or when member 106*a* encounters cylinder 101 and can be rotated no further, or when piston 102 reaches the end 116 of the cylinder 101 (whichever comes first). The cylinder 101, the piston 102, and the piston rod 104 may be arranged so that this minimum compression volume 11 is as small as possible or practicable, so as to maximize the stroke volume of the pump. However, any ending minimum volume for compression volume 11 may be employed as needed or desired, e.g., for achieving a specific desired stroke volume or compression ratio for each pump stroke. For example, the minimum compression volume may be chosen so that the maximum pressure achieved in the pump does not exceed maximum pressure safety limits of hoses, fittings, gauges, or other components linked to the pump.

The air pump may be arranged so that members 106*a* and 108*a* are substantially parallel to the cylinder (as in FIG. 1F) when pivot 107*a* reaches pivot 105*a*. This may be desirable for achieving a desired force versus pressure curve or for storage or portability of the pump (described further hereinbelow). Once the pressure within the compression volume 11 reaches the pressure of a target reservoir (plus some additional opening pressure for a suitable valve; reservoir and valve not shown), the air in the compression volume 11 flows into the reservoir through outlet 120. Once the downstroke is completed, the handle 112 is pulled upward, reversing the movements of the piston 102, piston rod 104, and members 106*a*, 108*a*, and 110*a*. Once the piston 102 passes hole 118 on its way upward through the cylinder 101 (i.e., on the upstroke, or recovery stroke), more air enters the cylinder 101 through the hole 118 for compression during the next downstroke.

The handle 112 and the guide rod 114 can be substantially rigidly connected, or one or both can be arranged so as to enable a substantially rigid connection to be established therebetween when needed or desired. In an example of this second case, the handle 112 can be pivotably connected to the guide rod 114 so as to be movable between a position substantially perpendicular to the cylinder 101 (as in FIGS. 1A-1F) and a position substantially parallel to the cylinder (as in FIG. 3A). The parallel position may be desirable for storage or portability of the pump, particularly if members 106*a* and 108*a* are arranged for lying parallel to the cylinder 101 at the end of the downstroke. The air pump can further include a base 122 secured to the first end 116 of the cylinder and arranged to enable use of the air pump with the first end of the cylinder resting on the ground (as in FIG. 3B). The base 122 and the cylinder 101 can be substantially rigidly connected, or one or both can be arranged so as to enable a substantially rigid connection to be established therebetween when needed or desired. In an example of this second case, the base 122 can be pivotably connected to the cylinder 101 so as to be movable between a position substantially perpendicular to the cylinder 101 (as in FIGS. 1A-1F) and a position substantially parallel to the cylinder (not shown). The parallel position may be desirable for storage or portability of the pump, particularly if members 106*a* and 108*a* are arranged for lying parallel to the cylinder 101 at the end of the downstroke.

Figure 4:
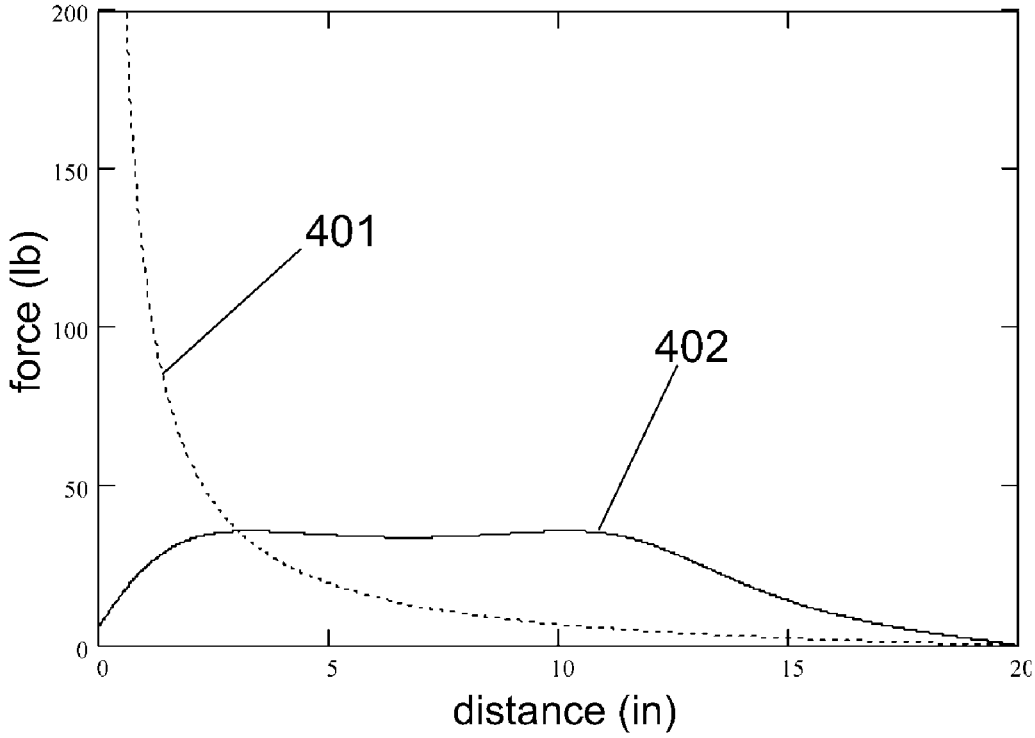
FIG. 4 is an applied force versus pump stroke distance curve for the air pump of FIGS. 1A-1F.
Figure 5:
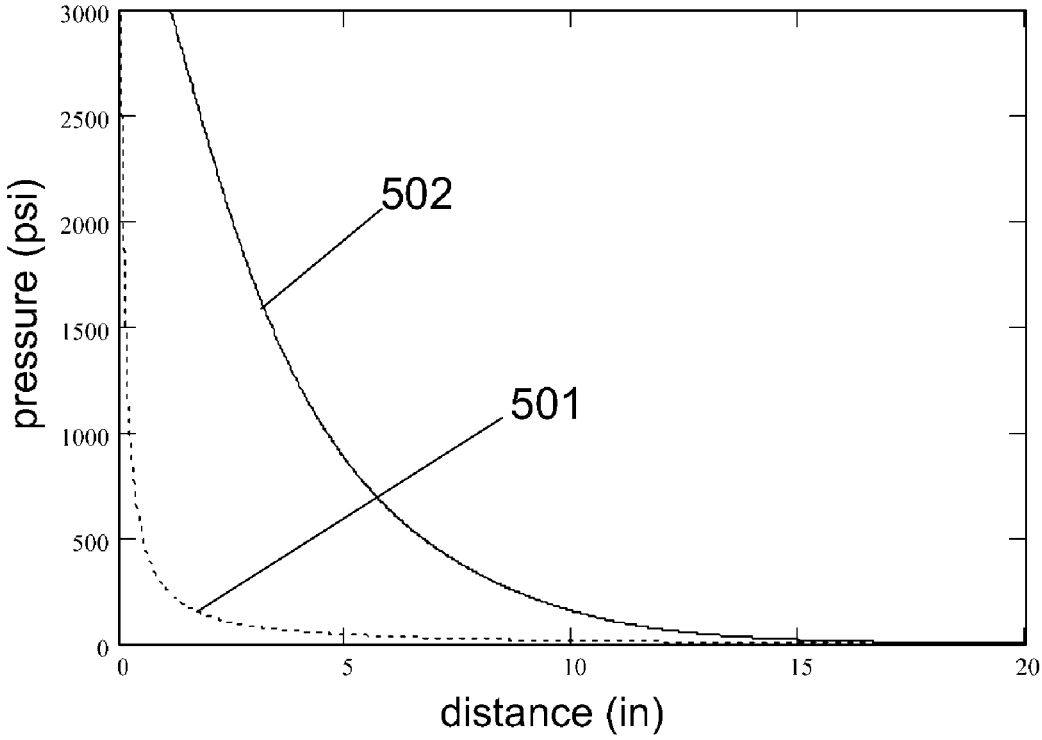
FIG. 5 is a pressure versus pump stroke distance curve for the air pump of FIGS. 1A-1F.

An air pump configured as shown in FIGS. 1A-1F and constructed with the dimensions given below exhibits applied force versus pump stroke distance curve 402 and pressure versus pump stroke distance curve 502 shown in FIGS. 4 and 5, respectively. The dimensions are:

| | |
|---|---|
| member 106a (105a to 109a) | 10 inches |
| member 108a (107a to 109a) | 10.5 inches |
| member 110a (109a to 111a) | 16 inches |
| handle 112 (111a to 114) | 8 inches |
| cylinder length (118 to 116) | 16.5 inches |
| cylinder diameter | 0.75 inches |

When constructed with these dimensions, pressures of up to 3000 psi can be generated without requiring any applied force greater than about 40 lbs. This is in marked contrast to a simple linear pump (corresponding curves 401 and 501 shown in FIGS. 4 and 5 for comparison), wherein up to 200 lbs. of force may be required to generate similar reservoir pressure (with a cylinder diameter of about 0.29 inches). In addition to the reduced force requirement, the air pump of FIGS. 1A-1F delivers over six times the volume per stroke due to the larger piston area. If the stroke volumes are equalized, then the force required using the simple linear pump increases to impractical values (e.g. well over 1000 lbs.). These dimensions are exemplary only; a wide variety of combinations of dimensions may be employed for achieving a needed or desired force/pressure versus distance curves depending on the operational requirements of the air pump. One example of a desirable force profile would be a relatively flat profile, wherein the force is relatively constant (within operationally acceptable limits) over the duration of the pump stroke. Force-distance and pressure-distance curves may be readily calculated using standard mechanical engineering techniques described in a variety of basic text books (e.g., Arthur G. Erdman and George N. Sandor, *Mechanism Design: Analysis and Synthesis,* 2ed Prentice Hall (1984), hereby incorporated by reference as if fully set forth herein).

Figure 2:
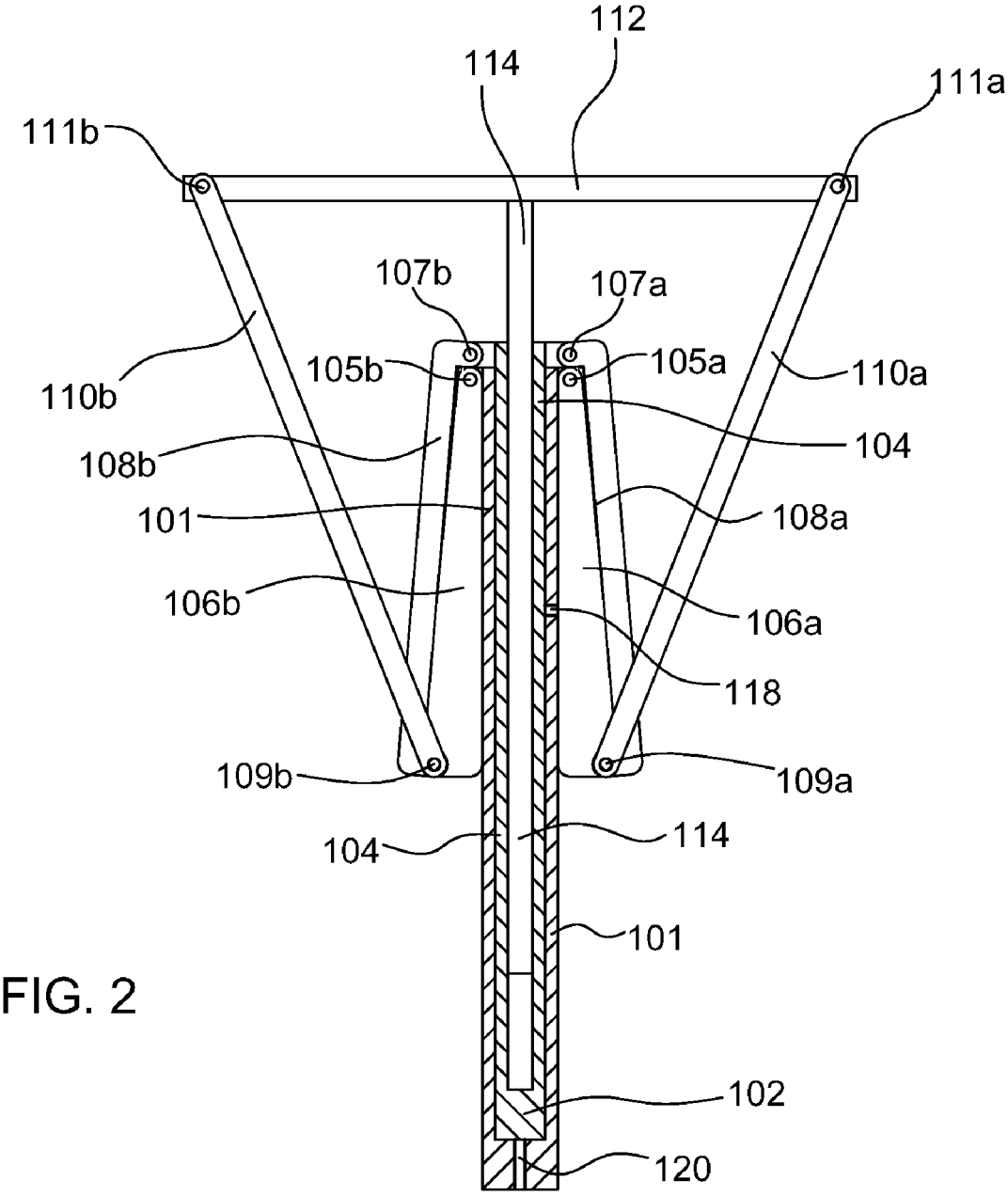
FIG. 2 illustrates schematically an exemplary embodiment of an air pump with limiter.

As shown in FIG. 2, members 106*a* and 106*b* can be arranged so as to stop movement of the handle, members, and piston before members 106*a* and 106*b* become parallel to the cylinder and an infinite mechanical advantage is achieved. This infinite mechanical advantage manifests itself as the decrease in force as the distance approaches zero (curve 402 of FIG. 4). Since this portion of the pump stroke is somewhat "wasted" (as far as performing work to further compress the air in the cylinder), limiting the motion of members 106*a* and 106*b* eliminates this "wasted" portion of the pump stroke. Any suitable mechanical limiter on members 106*a/b*, 108*a/b*, or 110*a/b*, of on the cylinder 101 may be employed for limiting the motion in this way. Alternatively, the motion may be limited by arranging piston 102 and cylinder 101 so that piston 102 reaches the end 116 of the cylinder 101 before member 106*a* becomes parallel to the cylinder 101.

A second exemplary embodiment of an air pump is shown in FIGS. 6A-6E, and comprises: a cylinder 201; a piston 202; a piston rod 204; a set of three substantially rigid members 206, 208, and 210; and a handle 212. Piston 202 is reciprocably movable within the cylinder 201 and defines a compression volume 21 within the cylinder 201 between the piston 202 and the first end 216 of the cylinder 201. Piston rod 204 is substantially rigidly secured to the piston 202 and extends along the cylinder 201 toward its second end. The first substantially rigid member 206 is pivotably connected at its first end to the cylinder 201 at pivot 205. The second substantially rigid member 208 is pivotably connected at its first end to the piston rod 204 at pivot 207 and pivotably connected at its second end to the second end of the first member 206 at pivot 209. The third substantially rigid member 210 is pivotably connected at its first end to the connected second ends of the first and second members 206 and 208 at pivot 209. The handle 212 is pivotably connected at its first end to the cylinder 201 at pivot 213 and at an intermediate point to the second end of the third member 210 at pivot 211. The second end of handle 213 extends beyond pivot 211.

In this exemplary embodiment, rotation axes of the pivots 205, 207, 209, 211, and 213 connecting the cylinder 201, the piston rod 204, the members 206, 208, and 210, and the handle 212 are substantially parallel to one another and are substantially perpendicular to the axis of the cylinder 201. This arrangement of the pivots 205, 207, 209, 211, and 213 results in substantially coplanar arrangement and movement of the members 206, 208, and 210 as the piston 202 moves along the cylinder 201. Other suitable arrangements shall fall within the scope of the present disclosure or appended claims. The third member 210 is arranged to transmit, between the handle 212 and the connected second ends of the first and second members 206 and 208, a force generally directed toward the first end 216 of the cylinder 201 resulting from a force applied to the handle 212 and generally directed toward the first end of cylinder 101.

Figure 6A:
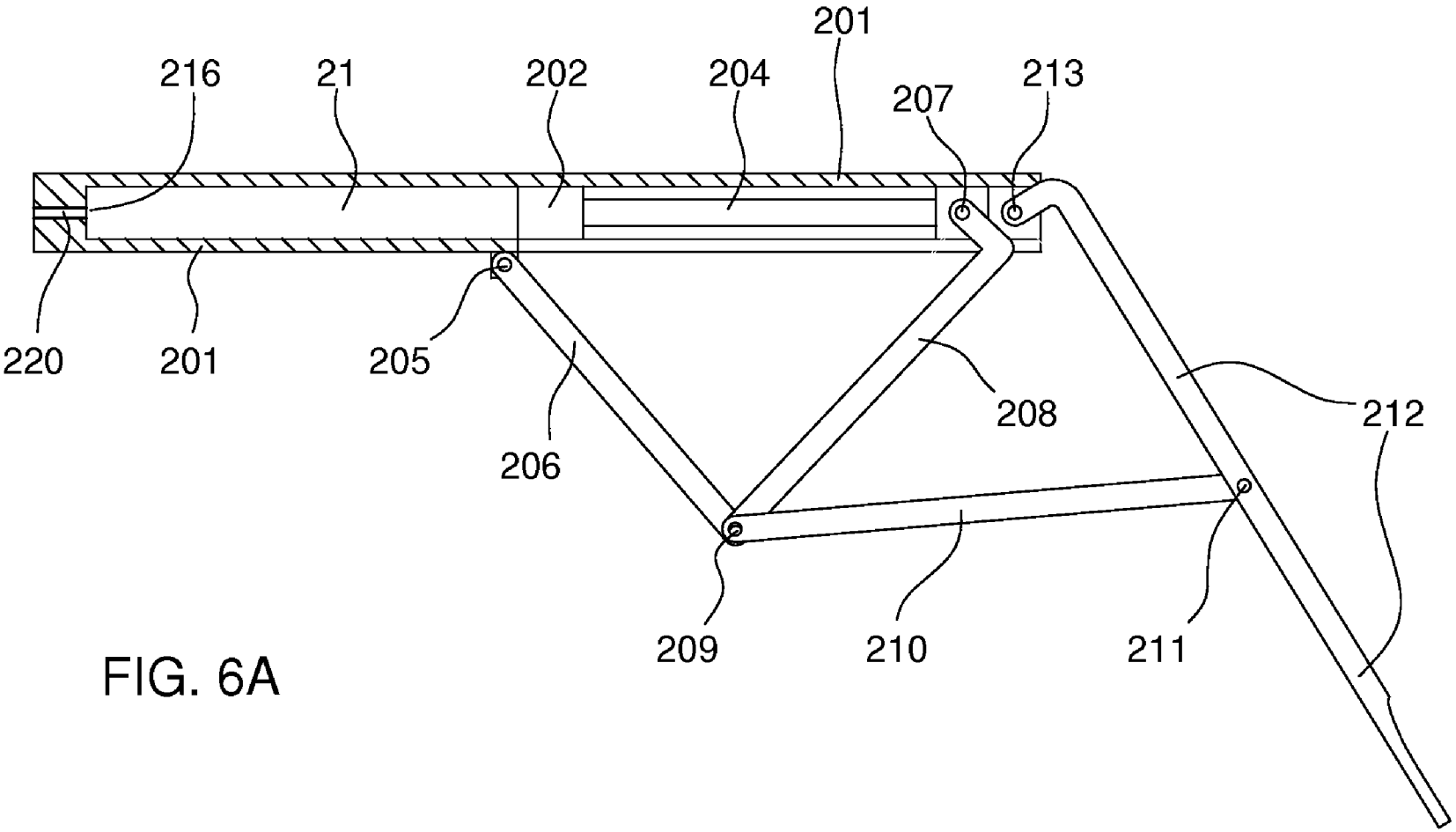
FIGS. 6A-6E illustrate schematically structure and operation of another exemplary embodiment of an air pump.
Figure 6B:
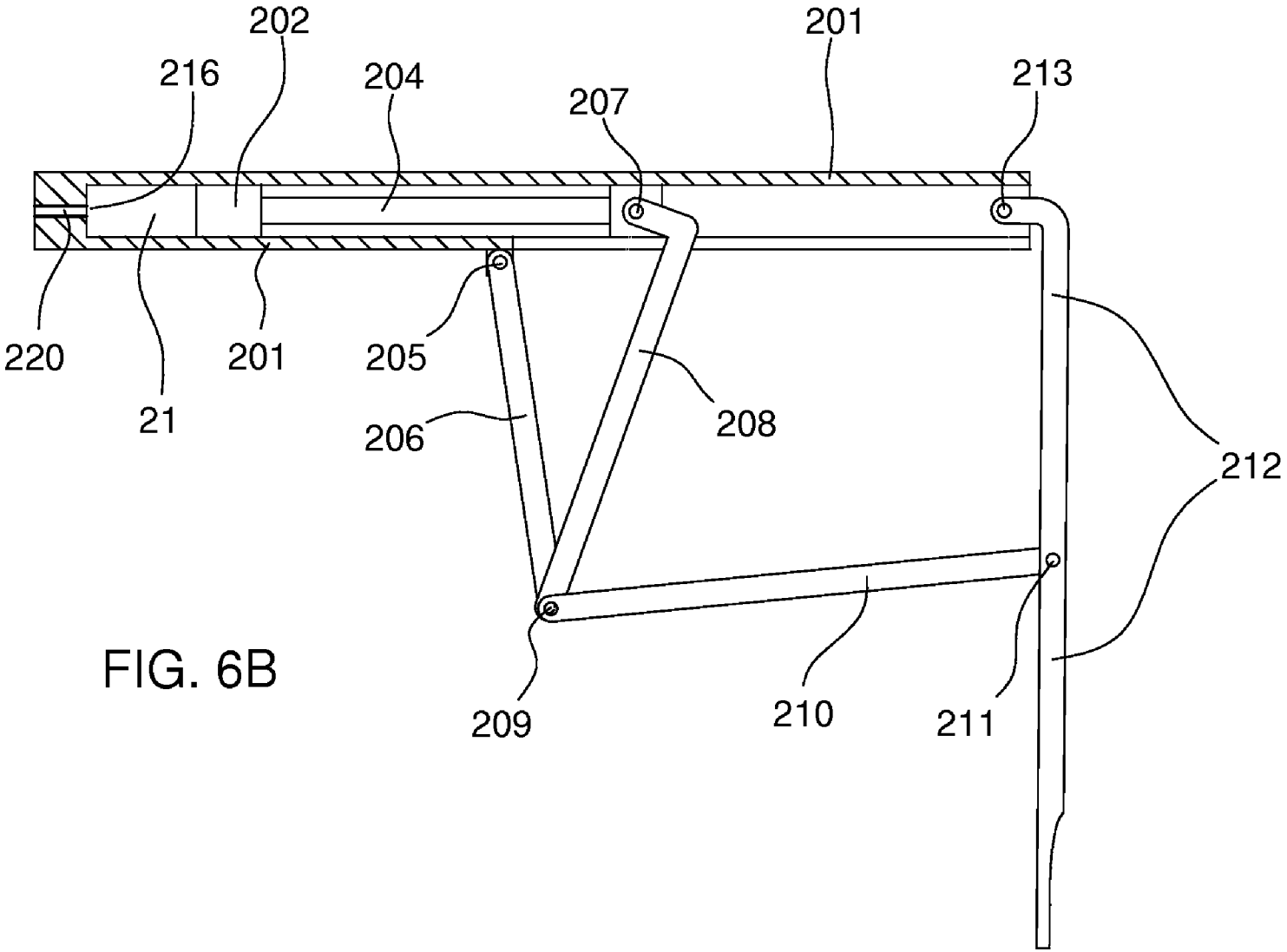
Figure 6C:
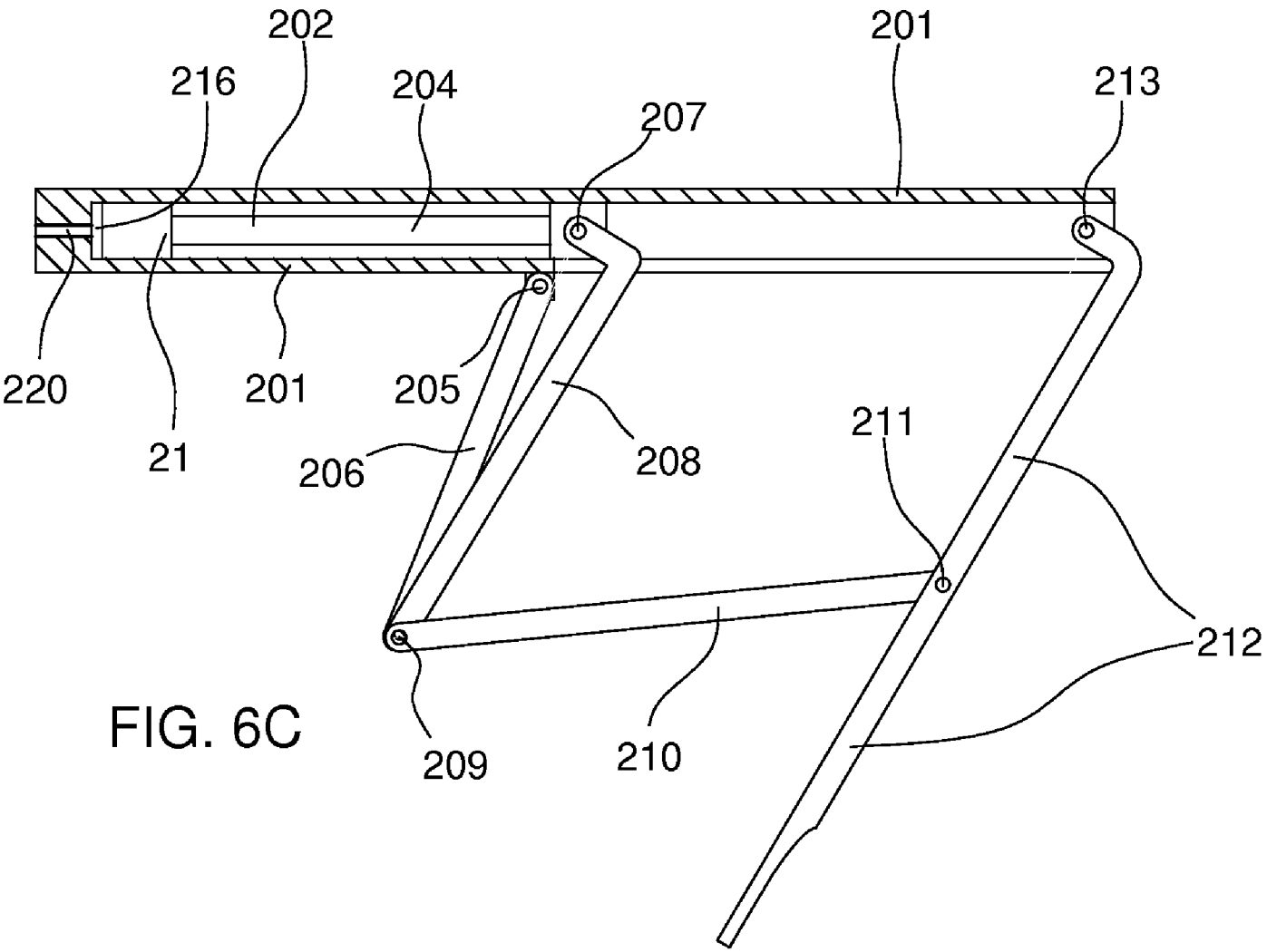
Figure 6D:
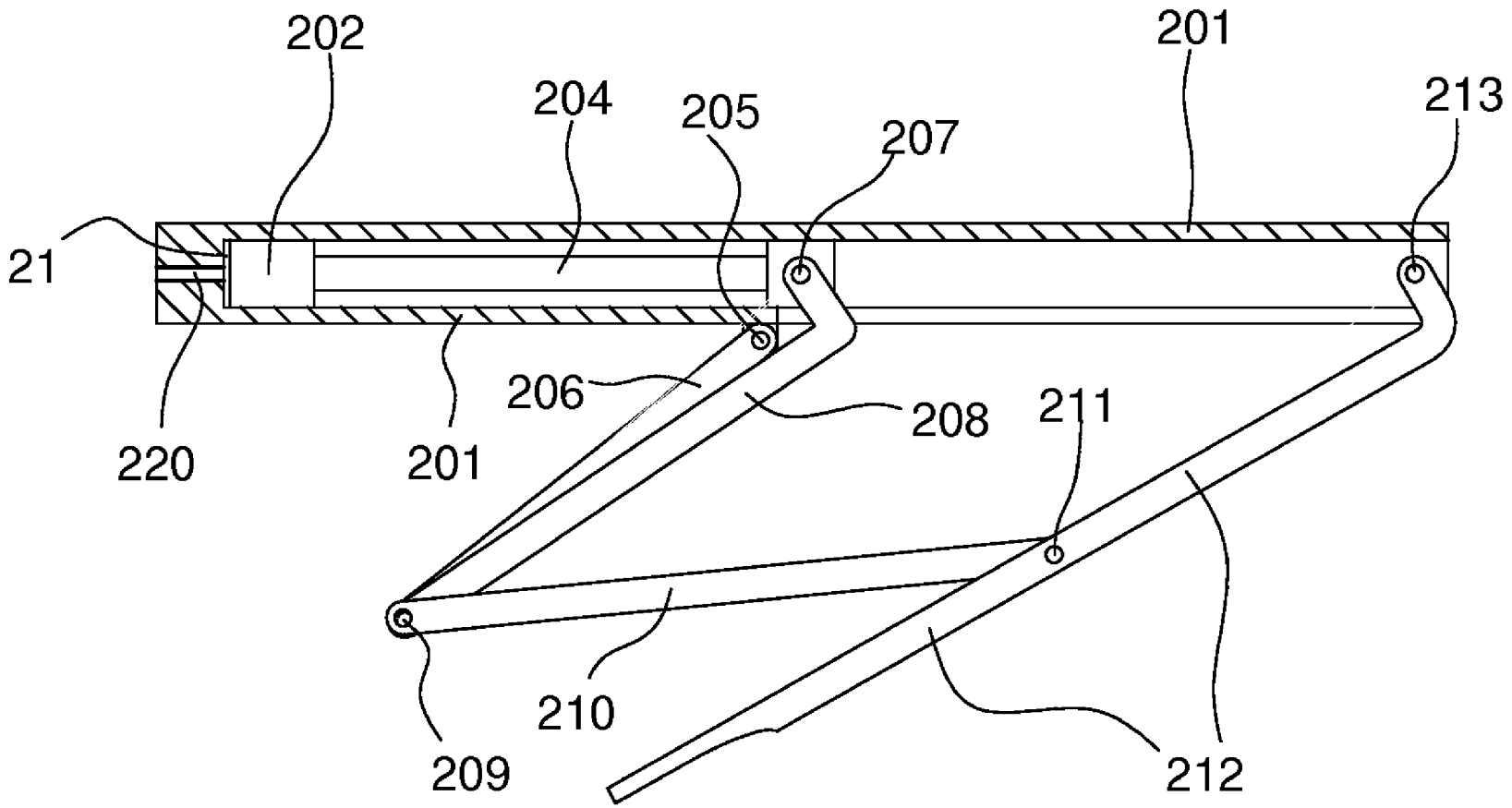
Figure 6E:
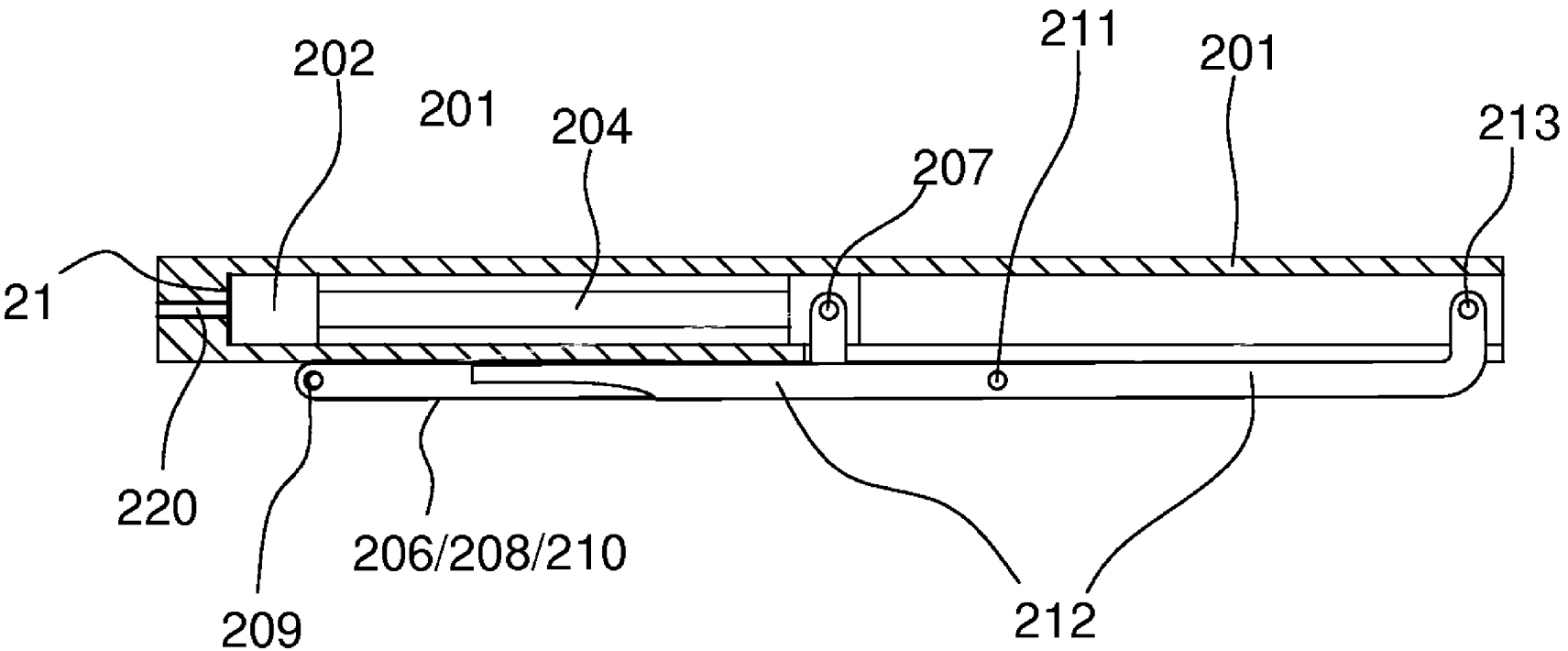

The operation of this second exemplary pump is illustrated in the sequence of FIGS. 6A-6E. In FIG. 6A, the pump is shown at the beginning of a stroke, with the piston 202 at its furthest position from the first end 216 of cylinder 201 and the compression volume 21 at its maximum size. Any suitable inlet may be provided for allowing air to enter the compression volume 21. During a pump stroke, air trapped within the compression volume 21 is compressed by movement of the piston 202 within cylinder 201. Any suitable structure or mechanism may be employed for allowing entry of air into compression volume 201 at the beginning of a pump stroke, including those recited hereinabove. Air compressed during the pump stroke may exit the compression volume through outlet 220 at the first end 216 of cylinder 201. Any suitable structure of mechanism may be employed at outlet 120, including those recited hereinabove.

As force is applied on the end of handle 212, it rotates toward the cylinder 201 about pivot 213. The force applied to handle 212 is transmitted to the connected ends of the members 206 and 208 at pivot 209 by member 210 as a force directed generally toward the first end 216 of cylinder 201. This results in rotation of member 206 about pivot 205, and tension being applied to member 208, which in turn urges piston rod 204 and piston 202 toward end 116 within cylinder 101 and reduces the compression volume 21. The sequence of movements in illustrated in FIGS. 6A-6E. Air trapped within the compression volume 21 is compressed by movement of piston 202 within cylinder 201. The end of the pump stroke and minimum compression volume occurs when pivot 207 reaches pivot 205 and can go no further, when member 206 or handle 212 encounters cylinder 201 and can be rotated no further (as in FIG. 6E) or when piston 202 reaches the end 216 of cylinder 201 (whichever comes first). The cylinder 201, the piston 202, and the piston rod 204 may be arranged so that this minimum compression volume 21 is as small as possible or practicable, so as to maximize the stroke volume or compression ratio of the pump. However, any ending minimum volume for compression volume 21 may be employed as needed or desired (as described hereinabove). For example, the minimum compression volume may be chosen so that the maximum pressure achieved in the pump does not exceed maximum pressure safety limits of hosed, fittings, gauges, or other components linked to the pump.

The air pump may be arranged so that members 206, 208, and 210, and handle 212 are substantially parallel to the cylinder (as in FIG. 6E) when pivot 207 reaches pivot 205. This may be desirable for achieving a desired force versus pressure curve or for storage or portability of the pump (described further hereinbelow). Once the pressure within the compression volume 21 reaches the pressure of a target reservoir (plus some additional opening pressure for a suitable valve; reservoir and valve not shown), the air in the compression volume 21 flows into the reservoir through outlet 220. Once the pump stroke is completed, the handle 212 may be rotated away from cylinder 201, reversing the movements of the piston 202, piston rod 204, and members 206, 208, and 210 in preparation for the next pump stroke.

Figure 10:
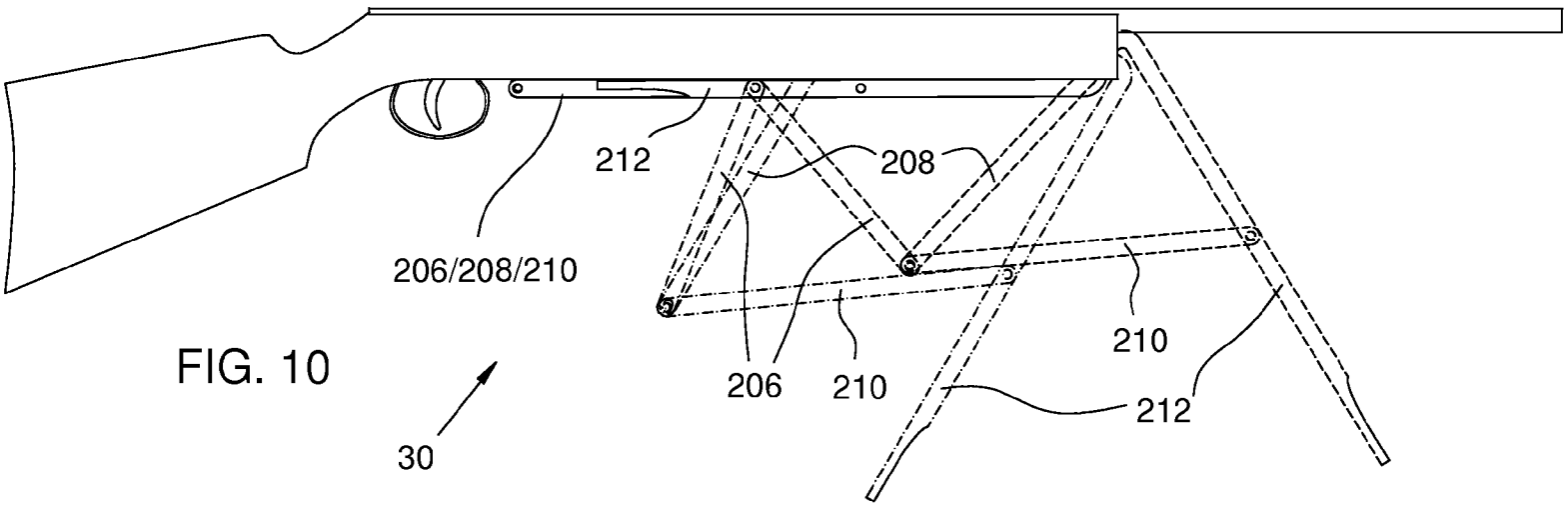
FIG. 10 illustrates schematically the pump of FIGS. 6A-6E installed on an air gun.

The air pump embodiment of FIGS. 6A-6E is well-suited for mounting on an air gun and for charging the air gun 30 for subsequent firing (as shown in FIG. 10). The air pump outlet can be operatively coupled to a compressed air reservoir in the air gun, which is then used to propel the projectile when the air gun is fired. The reservoir may be connected to the barrel of the gun through a firing valve arranged for rapidly releasing the compressed air from the reservoir into the barrel to propel a projectile. The three members 206, 208, and 210 and the handle 212 are arranged to lie substantially parallel to the cylinder 201 when the piston 202 is positioned to define the minimum operational compression volume 21 (as in FIGS. 6E and 10). Such an arrangement is particularly appropriate when the air pump is incorporated into an air gun, so that the members 206, 208, and 210 and the handle 212 can all lie parallel to and against the body or barrel of the gun without interfering with handling, aiming, or firing the air gun.

Figure 7:
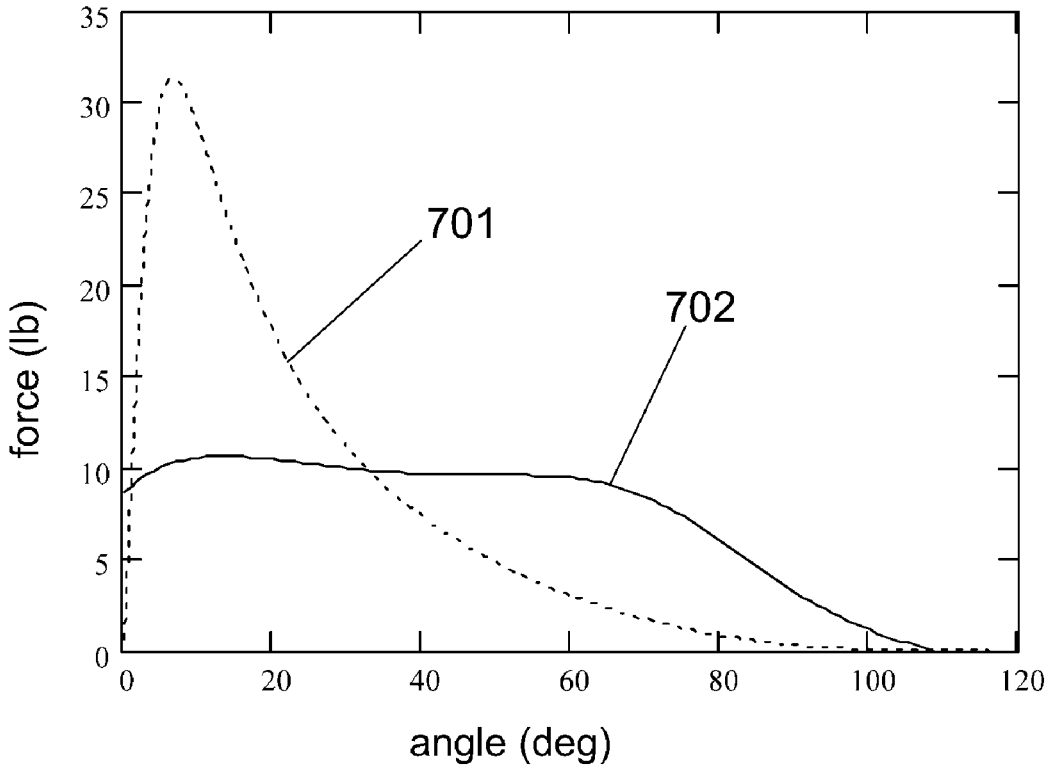
FIG. 7 is an applied force versus pump stroke angle curve for the air pump of FIGS. 6A-6E.
Figure 8:
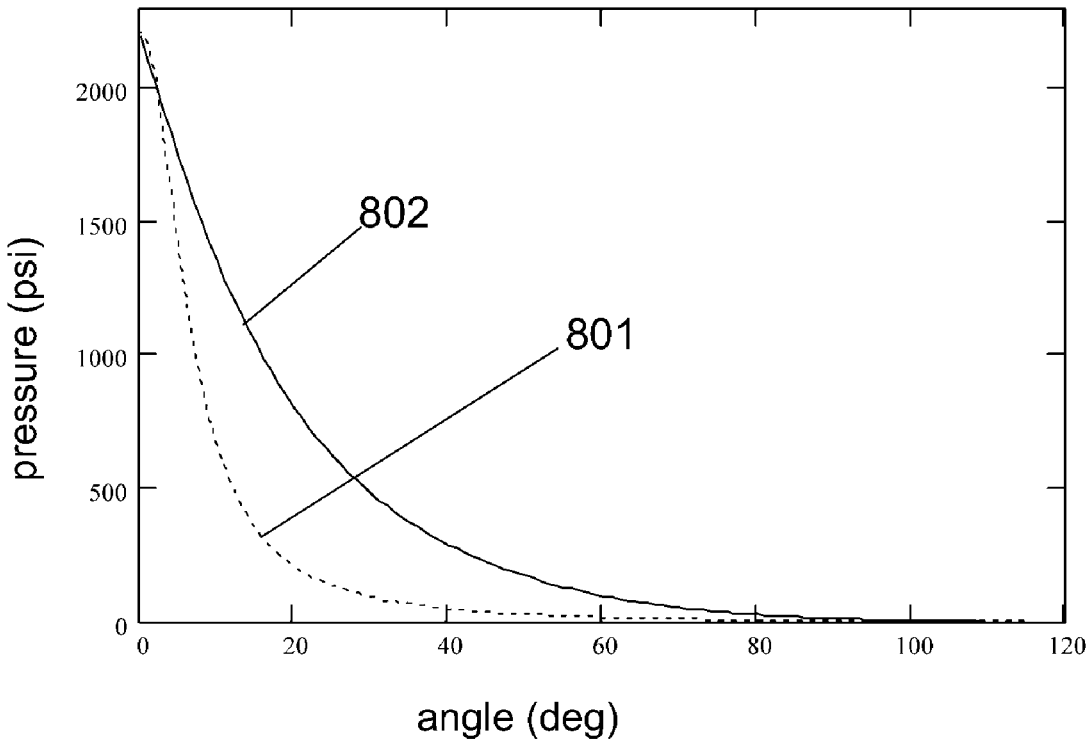
FIG. 8 is a pressure versus pump stroke angle curve for the air pump of FIGS. 6A-6E.

An air pump configured as shown in FIGS. 6A-6E and constructed with the dimensions given below exhibits applied force versus piston stroke angle curve 702 and pressure versus piston stroke angle curve 802 shown in FIGS. 7 and 8, respectively. The dimensions are:

| | |
|---|---|
| member 206 (205 to 209) | 5.35 inches |
| member 208 (207 to 209) | 5.90 inches |
| member 210 (209 to 211) | 8.40 inches |
| handle 212 (213 to 211) | 5.87 inches |
| handle 212 (213 to end) | 14 inches |
| cylinder length (202 to 216) | 8.90 inches (at 120°) |
| cylinder diameter | 0.75 inches |

When constructed with these dimensions, pressures of greater than 2000 psi can be generated with eight strokes without requiring any applied force greater than about 10 lbs. This is in contrast to prior air gun pump mechanisms (such as pump 90 shown in FIG. 9; corresponding curves 701 and 801 shown in FIGS. 7 and 8 for comparison), wherein over 30 lbs. of force may be required to generate similar compressed air pressure. These dimensions are exemplary only; a wide variety of combinations of dimensions may be employed for achieving a needed or desired force or pressure versus distance curves depending on the operational requirements of the air pump. One example of a desirable force profile would be a relatively flat profile, wherein the force is relatively constant (within operationally acceptable limits) over the duration of the pump stroke. The curves may be readily calculated using standard mechanical engineering techniques described in a variety of basic text books (e.g., Erdman and Sandor cited hereinabove). The reduction in force required to adequately pump the air gun for firing results in a lesser degree of fatigue for the user, in turn enabling improved shooting accuracy.

Figure 9:
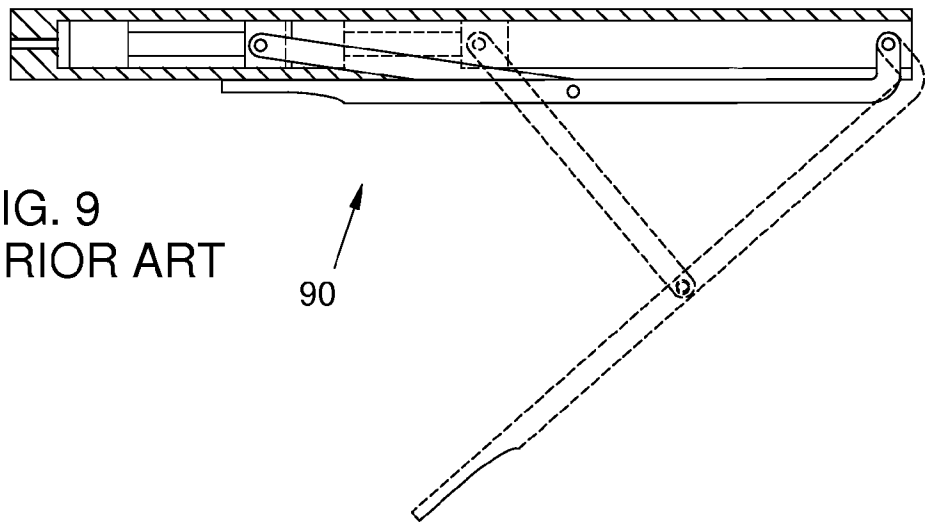
FIG. 9 PRIOR ART
FIG. 9 illustrates schematically a prior-art air pump.

This embodiment of FIGS. 6A-6E reduces the maximum force required to pump air guns relative to the prior art mechanism of FIG. 9, yet substantially conforms to the standard shape and motion of standard air gun pump mechanisms. The members are all located on one side of the gun under the barrel and the cocking handle is normally part of the stock. The length of each element described in the previous table interacts to determine the shape of the handle force curve depicted in FIG. 7. The lengths of the members can be selected so as to yield a relatively flat force profile (within operationally acceptable limits). The members can be arranged so as to collapse into the cylinder to create a smooth gun profile after cocking. The handle and members can be arranged so that an inversion of members 212, 210, and 206 hold handle 212 in position against cylinder 21 under the force from pressure on piston 202. Such an inversion occurs when pivot 211 crosses the line of action between pivot 213 and 209.

While the embodiments disclosed herein have been described as air pumps, it should be noted that the disclosed pumps may be used to pump others gases or fluids as needed or desired, and that such uses shall fall within the scope of the present disclosure or appended claims. It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims.

For purposes of the present disclosure and appended claims, the phrase "connected . . . to" shall denote a connection between two objects either directly or through some intermediate object or member.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: i) it is explicitly stated otherwise, e.g., by use of "either . . . or", "only one of . . . ", or similar language; or ii) two or more of the listed alternatives are mutually exclusive within the particular context, in which case "or" would encompass only those combinations involving non-mutually-exclusive alternatives.

For purposes of the present disclosure or appended claims, the words "comprise", comprising", "have", "having", "include", "including", and so on shall be construed as being open-ended, e.g., "including" shall be construed as "including but not limited to".

What is claimed is:

1. An air pump, comprising:

a cylinder;

a piston reciprocably movable within the cylinder and defining a compression volume within the cylinder between the piston and a first end of the cylinder;

a piston rod substantially rigidly secured to the piston and extending along the cylinder toward its second end;

a first substantially rigid member pivotably connected at its first end to the cylinder;

a second substantially rigid member pivotably connected at its first end to the piston rod and pivotably connected at its second end to the second end of the first member;

a third substantially rigid member pivotably connected at its first end to the connected second ends of the first and second members; and a handle pivotably connected to the second end of the third member, wherein the third member is arranged to transmit, between the handle and the connected second ends of the first and second members, a force resulting from a force applied to the handle wherein the handle is reciprocably movable in a direction substantially parallel to an axis of the cylinder, wherein the first and second members are arranged substantially parallel to the cylinder when the piston is positioned substantially at the end of a pump stroke.

2. An air pump, comprising:

a cylinder;

a piston reciprocably movable within the cylinder and defining a compression volume within the cylinder between the piston and a first end of the cylinder;

a piston rod substantially rigidly secured to the piston and extending along the cylinder toward its second end;

a first substantially rigid member pivotably connected at its first end to the cylinder;

a second substantially rigid member pivotably connected at its first end to the piston rod and pivotably connected at its second end to the second end of the first member;

a third substantially rigid member pivotably connected at its first end to the connected second ends of the first and second members;

a handle pivotably connected to the second end of the third member, wherein the third member is arranged to transmit, between the handle and the connected second ends of the first and second members, a force resulting from a force applied to the handle wherein the handle is reciprocably movable in a direction substantially parallel to an axis of the cylinder; and a guide rod connected to the handle and reciprocably movable within the piston rod.

3. The air pump of claim 2, wherein the handle or the guide rod is arranged so as to enable a substantially rigid connection to be established therebetween.

4. The air pump of claim 2, wherein at least a portion of the handle is pivotably connected to the guide rod so as to be movable between a position substantially perpendicular to the cylinder and a position substantially parallel to the cylinder.

5. An air pump, comprising:

a cylinder;

a piston reciprocably movable within the cylinder and defining a compression volume within the cylinder between the piston and a first end of the cylinder;

a piston rod substantially rigidly secured to the piston and extending along the cylinder toward its second end;

a first substantially rigid member pivotably connected at its first end to the cylinder;

a second substantially rigid member pivotably connected at its first end to the piston rod and pivotably connected at its second end to the second end of the first member;

a third substantially rigid member pivotably connected at its first end to the connected second ends of the first and second members;

a handle pivotably connected to the second end of the third member, wherein the third member is arranged to transmit, between the handle and the connected second ends of the first and second members, a force resulting from a force applied to the handle wherein the handle is reciprocably movable in a direction substantially parallel to an axis of the cylinder; and a base secured to the first end of the cylinder and arranged to enable use of the air pump with the first end of the cylinder resting on the ground.

6. The air pump of claim 5, wherein the base or the cylinder is arranged so as to enable a substantially rigid connection to be established therebetween.

7. The air pump of claim 5, wherein at least a portion of the base is pivotably connected to the cylinder so as to be movable between a position substantially perpendicular to the cylinder and a position substantially parallel to the cylinder.

* * * * *

UNITED STATES PATENT AND TRADEMARK OFFICE

CERTIFICATE OF CORRECTION

PATENT NO. : 7,637,203 B2
APPLICATION NO. : 11/464192
DATED : December 29, 2009
INVENTOR(S) : Robert A. Moss It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 477 days.

Signed and Sealed this

Ninth Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,637,203 B2
APPLICATION NO. : 11/464192
DATED : December 29, 2009
INVENTOR(S) : Robert A. Moss It is certified that error appears in the above-identified patent and that said Letters Patent is hereby corrected as shown below:

On the Title Page, Item [56], In the References Cited:

Second column, line 4, "4,256,141" should read --4,265,141--.

In the Specification:

Column 1, line 15, "example. It" should read --example). It--.

Column 5, line 5, "text books" should read --textbooks--.

Column 5, line 20, "of on" should read --or on--.

Column 5, line 45, "handle 213" should read --handle 212--.

Column 5, line 61, "cylinder 101" should read --cylinder 201--.

Column 6, line 5, "volume 201" should read --volume 21--.

Column 6, line 9, "outlet 120" should read --outlet 220--.

Column 6, line 19, "end 116" should read --end 216--.

Column 6, lines 19 and 20, "cylinder 101" should read --cylinder 201--.

Column 6, line 21, "in illustrated" should read --is illustrated--.

Column 6, line 36, "hosed" should read --hoses--.

Column 7, line 34, "text books" should read --textbooks--.

Column 7, line 52, "212" should read --208--.

Column 7, line 53, "cylinder 21" should read --cylinder 201--.

Column 7, line 59, "others gases" should read --other gases--.

Column 8, line 17, "comprising"" should read --"comprising"--.

Signed and Sealed this
Fourteenth Day of June, 2016

Michelle K. Lee

Michelle K. Lee
*Director of the United States Patent and Trademark Office*